United States Patent [19]

Yoneyama et al.

[11] 4,047,958

[45] Sept. 13, 1977

[54] PHOTOGRAPHIC SENSITIVE MATERIALS

[75] Inventors: Masakazu Yoneyama; Toshimasa Usami; Shiyoichi Ino; Yoshiteru Sata, all of Minami-ashigara; Nobuo Yamamoto, Tokyo, all of Japan

[73] Assignee: Fuji Photo Film Co., Ltd., Minami-ashigara, Japan

[21] Appl. No.: 674,538

[22] Filed: Apr. 7, 1976

[30] Foreign Application Priority Data

Apr. 7, 1975 Japan ..... 50-42065

[51] Int. Cl.[2] ..... G03C 1/34

[52] U.S. Cl. ..... 96/87 R; 96/87 A; 96/114.2

[58] Field of Search ..... 96/87 A, 87 R, 85, 114, 96/109, 56, 114.2

[56] References Cited

U.S. PATENT DOCUMENTS

| | | | |
|---|---|---|---|
| 3,042,522 | 7/1962 | Ben-Ezra | 96/87 R |
| 3,489,567 | 1/1970 | McGraw | 96/87 R |
| 3,779,774 | 12/1973 | Cope | 96/87 |

*Primary Examiner*—John D. Welsh

*Attorney, Agent, or Firm*—Sughrue, Rothwell, Mion, Zinn and Macpeak

[57] ABSTRACT

A photographic sensitive material comprising a support having thereon at least one photographic emulsion layer, wherein at least one surface layer of the photographic sensitive material contains an alkylpolysiloxane having in the side chain thereof a polyoxyethylene chain, said alkylpolysiloxane being represented by the following general formula (I):

(I)

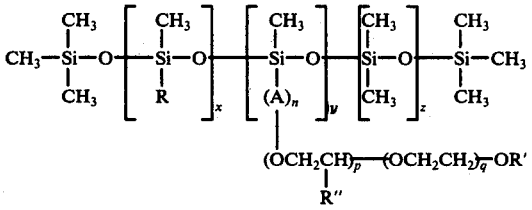

in which R represents an aliphatic group or aryl group, R′ represents a hydrogen atom, an aliphatic group or an aryl group R″ represents an alkyl group or alkoxyalkyl group, A represents divalent residue of an aliphatic hydrocarbon, $n$ represents 0 or an integer of 1 to 12, $p$ represents a value of 0 to 50, $q$ represents a value of 2 to 50, $x$ represents a value of 0 to 100, $y$ represents a value of 1 to 50, $z$ represents a value of 0 to 100 and $x + y + z$ represents a value of 5 to 250.

21 Claims, No Drawings

PHOTOGRAPHIC SENSITIVE MATERIALS

BACKGROUND OF THE INVENTION

1. FIELD OF THE INVENTION

This invention relates to photographic sensitive materials of improved photographic characteristics (for example, reduced fog). Particularly, it relates to color photographic sensitive materials in which abnormal coloration of a silver halide photographic emulsion layer is inhibited by incorporating into the surface layer thereof a polysiloxane containing a polyoxyalkylene chain in its side chain.

2. DESCRIPTION OF THE PRIOR ART

In photographic sensitive materials, one side or both sides of a support are coated directly or via a subbing layer with a sensitive photographic emulsion layer, and, if desired, further other layers such as an intermediate layer, protective layer, filter layer, antistatic layer and the like can be provided. As the support, α-polyolefin films such as polyethylene films, polystyrene films, cellulose ester films such as cellulose acetate films and cellulose nitrate films, polyester films such as polyethylene terephthalate films, paper or paper sheets coated with such film materials are used. Though in direct X-ray films both sides of the support are coated with a photographic emulsion, in most photographic sensitive materials only one side of the support is coated with a photographic emulsion. Accordingly, in the latter case there remains a side not coated with a photographic emulsion, that is, the surface of the support which is called the "back face" in this art.

In some sensitive materials, auxiliary layers are provided on the back face such as a halation preventing layer, an antistatic layer, an adhesion preventing layer, a curl preventing layer, an overcoat layer and the like in order to improve the photographic or physical properties of the photographic sensitive materials.

During handling of the materials, e.g., winding, rewinding, carrying upon photography, development, printing or projection as well as during manufacturing steps such as coating, drying and processing, photographic sensitive materials are often harmed by contact friction between the sensitive materials and various apparatus, machines and cameras due to contact therewith or due to friction or adhesion between photographic sensitive materials, namely, between the surface and the back face of the photographic sensitive materials. For example, there can occur scratches at the surface or back face of the photographic sensitive materials, a worsening of the ability to drive the sensitive materials in a camera and other machines and a stripping of the photographic layers from the photographic sensitive materials due to poor adhesion.

Recently, changes in methods of use and treatment of sensitive materials (e.g., high speed photography and high speed treatment) and diversified circumstances of use, e.g., under high temperature and high humidity conditions, have imposed more severe handling conditions upon sensitive materials than in the past, and, as a result, contact friction and adhesion troubles are now even more likely to occur, particularly at the surface of the sensitive materials.

For example, one serious problem caused by adhesion appears in color photographic films. In forming color photographic images there is generally used a color developing method which comprises reducing silver halide particles in an exposed photographic emulsion with a developing solution containing an aromatic primary amine as a developing agent, particularly an N,N-di-substituted-p-phenylenediamine compound, and reacting the oxidized product of the developing agent with various couplers to thereby form cyan, magenta and/or yellow dye images. As the couplers for such a color developing method there are generally used compounds which contain a phenolic hydroxy group, anilino amino group or an active methylene group and which form a dye that absorbs light of a certain region of the visible wavelength upon oxidative coupling with the aromatic primary amine developing agent.

When color photographic films, particularly those for motion pictures, are stored for long times under high humidity while tightly wound, adhesion between the back face and the surface of the color photographic film often takes place, and abnormal coloration shows up, particularly in the outermost photographic emulsion layer when the adhered films are separated and developed. For example, when a photographic emulsion layer containing in a blue sensitive photographic emulsion a coupler forming a yellow dye on coupling with a developing agent (e.g., of the p-phenylenediamine type) during development is provided at the top of the photographic emulsion layers, it colors yellow without exposure. This coloration makes the color picture obtained after processing indistinct to a great extent, and lowers the value of the film. Although the cause of this undesirable phenomenon has not yet completely established, it is believed that electrostatic charges are created on the surface of the film when adhered film sheets are separated which are hard to dissipate and which accumulate because of the poor conductivity of the photographic film, whereby the photographic emulsion is sensitized by static electricity discharge which accumulates beyond a certain limit. In this case, it is possible that the photographic emulsion will be sensitized by the light caused by the spark discharge or that the photographic emulsion will be sensitized by electric action due to electron streaming of a certain amount of the static electricity in the photographic emulsion. When the photographic emulsion is sensitized without exposure and blackening appears on development, this is called fogging in this art. Branch-like, feather-like or spot-like black images appear on the film after development when the photographic emulsion is sensitized, particularly by spark discharge due to static electricity, and these black images are called static marks.

In the case of using color sensitive materials, blackened silver does not remain in the sensitive materials since a bleach-fixing is conducted, but the coexisting coupler colors upon development.

In order to prevent such undesirable coloration due to fogging, the following methods have been used. One method eliminates the generation of static electricity. Since the generation of static electricity is caused by stripping adhered films, it can be stopped by decreasing the adhesiveness and adherence of the surfaces of the photographic materials, i.e., it is important to reduce the adhesiveness between the photographic emulsion layer surface and the back face. Another method is to impart to the photographic sensitive materials an antistatic capability, thereby reducing static charges.

Many techniques are known within these general methods. As examples of the former method, there is known a method which comprises dispersing in the surface layer of a photographic material a forming agent which forms projections, generally called a matting agent, such as inorganic compounds (e.g., silver halide, silica, barium strontium sulfate) and polymers (e.g., polymethyl methacrylate particles) to thereby make the surface layer coarse; a method which comprises incorporating in the surface layer of the sensitive materials a lubricant such as a liquid paraffin, a higher fatty acid ester on dimethylpolysiloxane, to thereby improve the frictional properties; and a method which comprises adding to a halation preventing layer of the back face a long chain carboxylic acid amide as is described in U.S. Pat. Nos. 2,732,305 and 3,433,638 to thereby prevent adhesion between the back face and the surface of the emulsion layer.

However, although these methods are effective to a certain extent to improve slippage, they are unexpectedly not effective in preventing the abnormal coloration of color photographic sensitive materials. Further, when in accordance with these methods the amount of the additives is increased to such an extent as to prevent abnormal coloration, these methods have the defects that transparency is impaired and condensates are liable to form in a coating liquid, thereby lowering the coating characteristics and imparting to the surface of the photographic sensitive material a tendency to be injured due to poor slippage. Further, transportation characteristics during coating and drying and processing are rather worsened and adhesives utilized to join photographic films are not effective because of the low sliding friction.

Further, there have been proposed methods for improving adhesion prevention by incorporating a certain kind of surface active agent in the surface layer of the photographic sensitive material, but most of these methods also have the defects that coating characteristics are worsened, photographic characteristics are worsened due to a reduction of sensitivity and the generation of fog and, further, the surface active agent's function is reduced by interaction with other additives such as antistatic agents and halation preventing agents. Further, dialkylpolysiloxane type silicone oils are known as lubricants for photographic film surfaces. For example, imparting slippage to a photographic film by the simultaneous incorporation of a dimethylpolysiloxane and a particular surface active agent into a photographic emulsion layer or protective layer is described in U.S. Pat. No. 3,042,522; imparting slippage by coating a mixture of a dimethylsilicone and diphenylsilicone on the back face of a photographic film base is described in U.S. Pat. No. 3,080,317; imparting slippage to a photographic film by incorporating into a protective layer methylphenylsilicone blocked with a terminal triphenyl is described in British Pat. No. 1,143,118; providing photographic sensitive materials having slippage and adhesion resistance by incorporating a di-lower alkylsilicone and a α-alanine surface active agent into a photographic emulsion layer or other hydrophilic colloid layer is described in U.S. Pat. No. 3,489,567; and using a polyoxyethylene adduct containing 3 silicon atoms in the molecule thereof as a coating aid is described in Japanese Patent Publication No. 34,230/70 . However, these dialkylpolysiloxane type silicone oils and fluorine oil (a polymer of monochlorotrifluoroethylene, for example, trade name "Daifloil" produced by Daikin Kogyo Co., Ltd.) are wholly uneffective to prevent the above described abnormal coloration, even if they are applied in color photographic materials to either a back layer or the surface of an emulsion layer or both of them.

Further, certain kinds of polymers, for example, copolymers of vinyl acetate and maleic acid half dodecylester and copolymers of styrene and maleic acid half heptylester are effective to some extent when applied to a back layer of a color sensitive material, but completely satisfactory effects cannot be obtained. In addition, such copolymers generate turbidity in the back layer after photographic treatment of the sensitive material, and bring about the tendency of these polymer coatings to strip from the back face and transfer to the surface of a photographic sensitive material when the surface of the photographic sensitive material and the back face are contacted under relatively high humidity and under pressure.

On the other hand, as a means for imparting antistatic characteristics, one way is to impart slippage to the surface of a sensitive material to thereby prevent the generation of static electricity, but this is not very effective. Therefore, reducing the generation of static electricity and electrification by adding an antistatic agent to the surface layer of film has generally been employed. Such a method is described in U.S. Pat. Nos. 3,625,696, 3,615,531, 3,564,043, 3,525,621, 3,457,076, 3,264,108 and 3,756,828, and most of the antistatic agents used for this purpose have characteristics which differ substantially from those of the aforementioned adhesion preventing agents dye to the hygroscopic properties of the antistatic agents.

As illustrated above, antistatic characteristics are generally incompatible with adhesion resistance characteristics. Therefore, it is very difficult to expect satisfactory effects on inhibiting abnormal coloration using conventional antistatic agents. That is to say, when a back face and a surface of a sensitive material containing such antistatic agent are contacted, adhesion tends to occur and when the adhered films are separated static charges tend to be generated more often than adhesion protection is imparted.

Although an abnormal coloration prevention effect can be expected if the generated static charges can be readily dissipated without accumulation, there are no antistatic agents which have such an excellent effect. In addition, even if such antistatic agents could be found, they would not be very effective since they would have the defects that they would render the film sticky and lower surface strength.

SUMMARY OF THE INVENTION

Accordingly, an object of the present invention is to provide a photographic sensitive material having a surface layer that does not adhere even under high temperature and humidity conditions when contacted with other surfaces.

Another object of the present invention is to provide a photographic sensitive material with lower fog.

A further object of the present invention is to provide a color photographic material with reduced abnormal coloration, particularly in the outermost emulsion layer.

Still a further object of the present invention is to provide a method for preventing abnormal coloration in the photographic emulsion layer of color photographic sensitive materials.

These objects have been attained by incorporating into the surface layer of a photographic sensitive material a certain alkylpolysiloxane having a polyoxyethylene chain in a side chain, that is, a copolymer of an alkylpolysiloxane comprising a polyoxyethylene chain and a polyalkylsiloxane.

The present invention thus comprises incorporating into at least one surface layer (that is, a back layer and/or a surface layer of photographic emulsion) of a sensitive material an alkylpolysiloxane having in the side chain a polyoxyethylene chain represented by the following general formula (I), the photographic sensitive material having at least one photographic emulsion layer on the support.

(I)

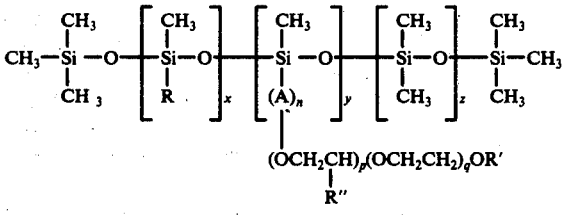

DETAILED DESCRIPTION OF THE INVENTION

In this specification, the surface of a photographic sensitive material means the surface of the side having at least one light sensitive emulsion layer, where the opposite surface of the above is called the "back face" of "back surface" of the photographic sensitive material.

In formula (I) above, R represents an aliphatic group e.g., an alkyl group (preferably having 1 to 18 carbon atoms), an aralkyl group (preferably having 7 to 18 carbon atoms), a substituted alkyl group such as an alkoxyalkyl group (preferably having 2 to 18 carbon atoms) or an aryloxyalkyl group (preferably having 7 to 18 carbon atoms), etc.) or an aryl group (preferably a monoaryl group), for example, methyl, ethyl, propyl, pentyl, cyclopentyl, cyclohexyl, dimethylpentyl, heptyl, methylhexyl, octyl, dodecyl, octadecyl, phenylethyl, methylphenylethyl, phenylpropyl, cyclohexylpropyl, benzyloxypropyl, phenoxypropyl, ethyloxypropyl, butyloxyethyl, phenyl and the like.

R′ represents a hydrogen atom, an aliphatic group (e.g., an alkyl group (preferably having 1 to 12 carbon atoms), an aralyl group (preferably having 7 to 12 carbon atoms), etc.) or an arkyl group (preferably a monoaryl group), for example, methyl, ethyl, propyl, butyl, amyl, hexyl, heptyl, octyl, nonyl, decyl, dodecyl, phenylethyl, phenyl, and the like.

R″ represents an alkyl group (preferably having 1 to 3 carbon atoms) or an alkoxyalkyl group (preferably having 2 to 8 carbon atoms), for example, methyl, ethyl, methoxymethyl, hexyloxymethyl, and the like. A represents a divalent residue of an aliphatic hydrocarbon, for example, methylene, 1-one-trimethylene, 2-methyl-1-one-trimethylene, and the like. $n$ represents 0 or an integer of 1 to 12, $p$ represents a value of 0 to 50, $q$ represents a value of 2 to 50 (preferably 2 to 30), $x$ represents a value of 0 to 100, $y$ represents a value of 1 to 50, $z$ represents a value of 0 to 100, and $x + y + z$ is a value of 5 to 250 (preferably 10 to 50).

Representative of compounds within general formula (I) are shown below.

(1)

-continued

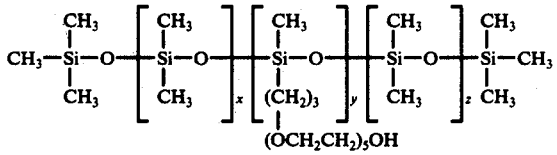

x + y + z = 30

(2)

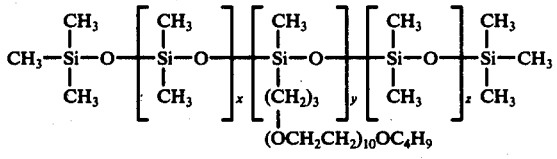

x + y + z = 40

(3)

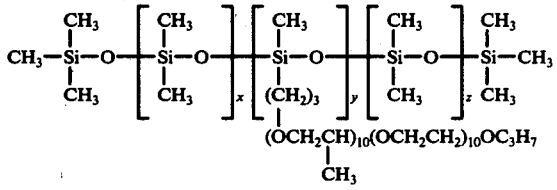

x + y + z = 35

(4)

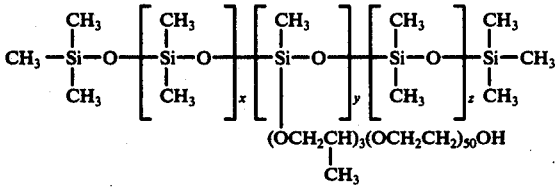

x + y + z = 50

(5)

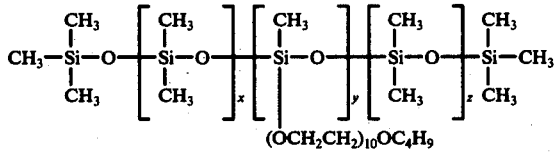

x + y + z = 100

(6)

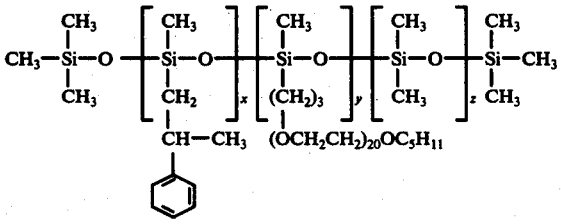

x + y + z = 40

(7)

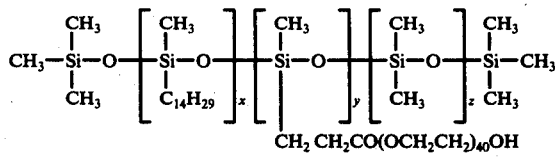

x + y + z = 200

-continued (8)

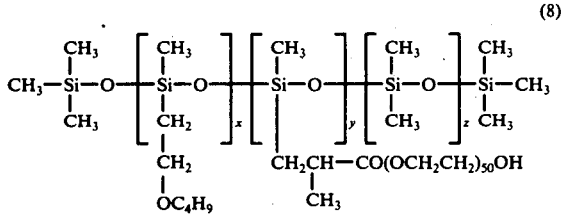

$x + y + z = 35$ (9)

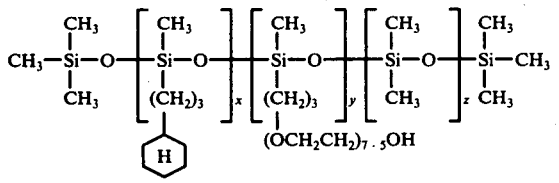

$x + y + z = 10$ (10)

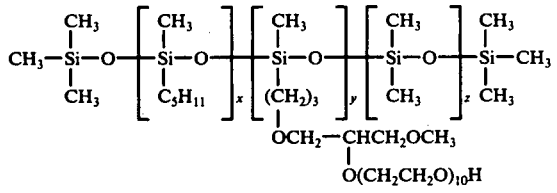

$x + y + z = 30$ (11)

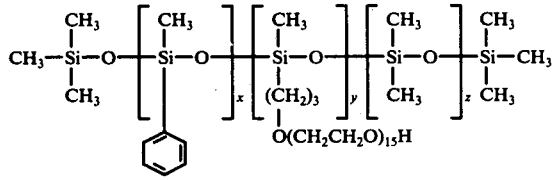

$x + y + z = 60$

Methods of producing compounds of general formula (I) are known, and are described in, for example, F. G. A. Stone and W. A. G. Graham, *Inorganic Polymers,* Academic Press, 1962, pp. 230 - 231, 288 - 295; W. Noll, *Chemistry and Technology of Silicones,* Academic Press, 1968, pp. 209 - 211; P. F. Bruins, *Silicone Technology,* A Division of John Willey and Sons, 1970, pp. 64 - 66; and J. P. Kennedy et al., *High Polymers,* Vol. 23, Second Part, pp. 773 - 775.

In more detail, such compounds can be prepared by hydrolyzing organochlorosilanes as described in Japanese Patent Publication No. 2,361/61; by the addition reaction of an SiH group containing siloxane with an olefin in the presence of metallic catalyst as described in Japanese Patent Publications Nos. 10,771/60, 28,694/68 and 14,898/70; by producing polyorganosiloxanes containing polyethylene oxide as described in U.S. Pat. No. 2,917,480, *Ind. and Eng. Chem. Prod. Res. and Dev.,* Vol. 6, No. 2, page 88, 1967, *Chemistry and Industry,* Vol. 19, page 147, 1966, published by the Japanese Association of Chemistry, Kogyo Kagaku Zasshi, Vol. 73, page 78, 1970, or as described in British Pat. No. 916,561 and French Pat. No. 1,353,669.

The viscosity of the compounds used in the present invention is not particularly limited and any compound which can be prepared by the above general methods exert a desirable effect, but generally compounds having a viscosity of about 20 to about 100,000 cs at 25° C are preferred.

In practicing the present invention, to a hydrophilic colloid solution for forming a surface layer of a sensitive photographic material and/or to a coating liquid for a non-sensitive photographic layer such as various coating liquids for forming a back layer are added: (1) a solution of a compound of general formula (I) in water, an organic solvent as later described for the binder, or a mixture thereof; or (2) an aqueous dispersion of a compound of general formula (I) which has been previously prepared in the presence of a suitable dispersing agent such as a surface active agent; and then the thus obtained liquid is coated on a photographic emulsion layer or support. Alternatively, (3) a compound of general formula (I) is overcoated on or impregnated in each photographic layer after the layer is coated on the support.

Compounds of general formula (I) are preferably incorporated into a back layer of a sensitive material (a surface layer of the sensitive material on the side opposite to the emulsion layer on the basis of support) since a remarkable abnormal coloration preventing effect can be obtained.

Coating or penetrating of the compounds of general formula (I) onto or into a sensitive material can be conducted using a dipping method as described in U.S. Pat. No. 3,335,026, an extrusion method as described in U.S. Pat. No. 2,761,791 and a spraying method as described in U.S. Pat. No. 2,674,167, etc.

Compounds of general formula (I) are coated or incorporated in an amount of about 0.01 to about 5.0 $g/m^2$ of photographic sensitive material per one side, particularly an amount of about 0.02 to about 2.0 $g/m^2$ being preferred. That is, where the compound of general formula (I) is coated on both sides of the photographic material the amount of the compound recited would be doubled in total. However, the above range is, of course, varied depending on the kind of photographic sensitive material, the form of the photographic sensitive material and the way of coating.

The compounds of the present invention can be applied to the back surface of a photographic sensitive material, and, when this mode is selected, preferably a binder is used. Since a back surface of a photographic sensitive material, in general, has no layer coated thereon, a binder is needed for application of the compound of general formula (I). As a matter of course, where a layer has already been provided on the back surface, no binder is necessary. The binder which can be used in the application of the compounds of general formula (I) includes cellulose esters such as cellulose triacetate, cellulose diacetate, cellulose acetate maleate, cellulose acetate phthalate, hydroxyalkylalkylcellulose phthalate and the like; polycondensates (in general, a 1 : 1 molar condensate, but this is not mandatory) such as a polycondensate of formaldehyde and cresol, salicylic acid or oxyphenylacetic acid, polycondensates of terephthalic acid or isophthalic acid and polyalkylene glycol and the like; homo- or copolymers obtained from polymerizable unsaturated bond-containing monomers such as homopolymers of acrylic acid, methacrylic acid, styrene-carboxylic acid or styrene-sulfonic acid, copolymers of such monomers or maleic anhydride with a styrene derivative, alkylacrylates, alkylmethacrylates, vinyl chloride, vinyl acetate, alkylvinylethers or acrylonitrile, or ring cleavage half ester or half amides thereof; partially hydrolyzed polyvinyl acetate, and polyvinyl alcohol. It should, however, be noted that the binders as are used in the invention are not limited to the above compounds, and any binders conventionally used in the art and hydrophilic or hydrophobic film forming polymers can also be used.

In using a binder, water, an organic solvent or a mixture thereof is used as solvent. Organic solvents include, for example, alcohols such as methanol, ethanol, butanol and the like; ketones such as acetone, methyl ethyl ketone and the like; halogenated hydrocarbons such as methylene chloride, carbon tetrachloride, chloroform and the like; ethers such as diethylether, dioxane, tetrahydrofuran and the like; and aromatic hydrocarbons such as benzene, toluene, xylene and the like.

When applying a mixture of a compound of general formula (I) and such a binder to the back face of a photographic sensitive material, the compound of general formula (I) is used in an amount of about 1 to about 300 wt%, more preferably 2 to 150 wt%, based on the weight of the binder which constitutes the back layer.

In the photographic sensitive materials of the present invention there can be used any support which is generally used as a support for photographic sensitive materials. For example, there may be mentioned cellulose nitrate film, cellulose acetate film, cellulose acetate butyrate film, cellulose acetate propionate film, polystyrene film, polyethylene terephthalate film, polycarbonate film and laminates thereof and paper. There may also be preferably used baryta or papers coated or laminated with an α-olefin polymer, particularly a polymer of an α-olefin with 2 to 10 carbon atoms such as polyethylene or polypropylene, and a plastic film whose surface has been coarsened to thereby improve adhesion to other polymers and to improve the printing characteristics as described in Japanese Patent Publication No. 19,068/72.

Various hydrophilic colloids can be used in the photograhic sensitive materials of the present invention. Hydrophilic colloids used as a binder for photographic emulsions and/or other photographic layers include, for example, gelatin, colloidal albumin, casein, cellulose derivatives such as carboxymethylcellulose and hydroxyethylcellulose, saccharide derivatives such as agar, sodium alginate and starch derivatives, synthetic hydrophilic colloids such as polyvinyl alcohol, poly-N-vinylpyrrolidone, acrylic acid copolymers, polyacrylamide or derivatives or partially hydrolyzed products thereof. If desired, a compatible mixture of two or more colloids as above mentioned can be used.

As the colloid gelatin is most generally used. Gelatin can be replaced in whole or in part not only by synthetic polymers but also by a gelatin derivative (obtained by treating or modifying gelatin with a reagent containing a group capable of reacting with the functional groups which are contained in the gelatin molecule such as amino, imino, hydroxy and carboxy groups or by a gelatin graft polymer containing a molecular chain of another polymer.

Reagents for producing such gelatin derivatives are isocyanates, acid chlorides and acid anhydrides as described in U.S. Pat. No. 2,615,928; acid anhydrides as described in U.S. Pat. No. 3,118,766; bromoacetic acid as described in Japanese Patent Publication No. 5,514/64; phenylglycidylether as described in Japanese Patent Publication No. 26,845/67; vinylsulfone compounds as described in U.S. Patent No. 3,132,945; N-allylvinylsulfonamides as described in British Patent No. 861,414; maleinimide compounds as described in U.S. Pat. No. 3,186,846; acrylonitrile as described in U.S. Pat. No. 2,594,293; polyalkylene oxides as described in U.S. Pat. No. 3,312,553; epoxy compounds as described in Japanese Patent Publication 26,845/67; acid esters as described in U.S. Pat. No. 2,763,639; and alkanesultones as described in British Pat. No. 1,033,189. Branched polymers as can be grafted onto gelatin are described in many literature citations and patents such as U.S. Pat. Nos. 2,763,625, 2,831,767, 2,956,884, *Polymer Letters,* Vol. 5, 595 (1967), *Phot. Sci. Eng.,* Vol. 9, 148 (1965), *J. Polymer Sci.,* A-1, Vol. 9, 3199 (1971), and polymers or copolymers of vinyl monomers such as acrylic acid, methacrylic acid or ester derivatives thereof, amide derivatives or nitrile derivatives thereof or styrene are widely used as the branched polymer. However, particularly preferred are hydrophilic vinyl polymers which are to some extent compatible with gelatin such as polymers or copolymers of acrylic acid, acrylic acid amide, methacrylic acid amide, hydroxyalkylacrylate and hydroxyalkylmethacrylate.

To the photographic emulsion layers or other layers of the present invention there can be added a synthetic polymer compound, for example, a latex-like vinyl polymer dispersed in water, particularly a compound which increases the dimensional stability of the photographic material, alone or in combination with other polymers or with hydrophilic water permeable colloids. Such polymers are described in U.S. Pat. Nos. 2,376,005, 2,739,137, 2,853,457, 3,062,674, 3,411,911, 3,488,708, 3,525,620, 3,635,715, 3,607,290, 3,645,740 and in British Pat. Nos. 1,186,699 and 1,307,373. Among the polymers described in these patents there are generally used copolymers and homopolymers of monomers selected from the group consisting of alkylacrylates, alkylmethacrylates, acrylic acid, methacrylic acid, sulfoalkylacrylates, sulfoalkylmethacrylates, glycidylacrylates, glycidylmethacrylates, hydroxyalkylacrylates, hydroxyalkylmethacrylates, alkoxyalkylacrylates, alkoxymethacrylates, styrene, butadiene, vinyl chloride, vinylidene chloride, maleic anhydride and itaconic anhydride. If desired, graft emulsion polymerized latexes obtained by the emulsion polymerization of a vinyl compound in the presence of a high molecular weight hydrophilic protective colloid may also be used.

Hardening of any photographic emulsions and/or other photographic layers may be conducted in a conventional manner, if desired. Examples of hardening agents are aldehyde type compounds such as formaldehyde, glutaraldehyde and the like; ketone compounds such as diacetyl, cyclopentadione and the like; bis(2-chloroethylurea); 2-hydroxy-4,6-dichloro-1,3,5-triazine; and further, compounds having a reactive halogen atom as described in U.S. Pat. Nos. 3,288,775 and 2,732,303 and British Pat. Nos. 974,723 and 1,167,207; divinylsulfone; 5-acetyl-1,3-diacryloylhexahydro-1,3,5-triazine; compounds containing a reactive olefin as described in U.S. Pat. Nos. 3,635,718, 3,232,763, 3,490,911 and 3,642,486 and British Pat. No. 994,869; N-hydroxymethylphthalimide; N-methylol compounds as described in U.S. Pat. Nos. 2,732,316 and 2,586,168; isocyanates as described in U.S. Pat. No. 3,103,437; aziridine compounds as described in U.S. Pat. Nos. 3,017,280 and 2,983,611; acid derivatives ad described in U.S. Pat. Nos. 2,725,294 and 2,725,295; carbodiimide compounds as described in U.S. Pat. No. 3,100,704; epoxy compounds as described in U.S. Pat. No. 3,091,537; isoxazole compounds as described in U.S. Pat. Nos. 3,321,313 and 3,543,292; halogenocarboxyaldehydes such as mucochloric acid; dioxane derivatives such as dihydroxydioxane and dichlorodioxane; and inorganic hardening agents such as chromium alum and zirconium sulfate. Instead of said compounds there can be used precursors of such compounds, such as an alkali metal bisulfite aldehyde adduct, a methylol derivative of hydantoin and an aliphatic primary nitroalcohol.

Any silver halide photographic emulsion used can be prepared in a conventional manner by mixing a solution of a water soluble silver salt such as silver nitrate with a solution of a water soluble halide such as potassium bromide in the presence of a solution of a water soluble high molecular weight polymer such as gelatin. As the silver halide there can be used silver chloride, silver bromide and mixed silver halides such as silver chlorobromide, silver iodobromide and silver chloroiodobromide. For high sensitivity silver halides for motion picture films silver halides are preferably used which contain silver bromide as a main component (about 0.5 to about 12 mol% of silver iodide preferably being present, and, if desired, about 2 to about 3 mol% of silver chloride further being present).

These silver halide particles can be prepared in a known conventional manner. It is, of course, possible to use a single or double jet method or a controlled double jet method. Alternatively, silver halide particles can be prepared by mixing two or more silver halide photographic emulsions which have been separately prepared.

The above photographic emulsion can have added thereto various compounds in order to prevent a sensitivity reduction and the occurrence of fog during the production, storage or processing of the sensitive material. Many such compounds have heretofore been known, for example, heterocyclic compounds such as 4-hydroxy-6-methyl-1,3,3*a*,7-tetrazaindene, 3-methylbenzothiazole, 1-phenyl-5-mercaptotetrazole and the like, mercury containing compounds, mercapto compounds, metal salts and the like. Many examples of such compounds are described in U.S. Pat. Nos. 1,758,576, 2,110,178, 2,131,038, 2,173,628, 2,697,040, 2,304,962, 2,324,123, 2,394,198, 2,444,605 to '608, 2,566,245, 2,694,716, 2,697,099, 2,708,162, 2,728,663 to '665, 2,476,536, 2,824,001, 2,843,491, 2,886,437, 3,052,544, 3,137,577, 3,220,839, 3,226,231, 3,236,652, 3,251,691, 3,252,799, 3,287,135, 3,326,681, 3,420,668, 3,619,198, 3,622,339, 3,650,759, British Pats. Nos. 893,428, 403,789, 1,173,609 and 1,200,188. In addition, the silver halide emulsion can be chemically sensitized in a conventional manner. As chemical sensitizers there can be used gold compounds such as chloroaurates and gold trichloride as described in U.S. Pats. Nos. 2,399,083, 2,540,085, 2,597,856, and 2,597,915; salts of noble metals such as platinum, palladium, iridium, rhodium, ruthenium and the like as described in U.S. Pats. Nos. 2,448,060, 2,540,086, 2,566,245, 2,566,263, and 2,598,079; sulfur compounds capable of forming silver sulfate upon reaction with a silver salt as described in U.S. Pats. Nos. 1,574,944, 2,410,689, 3,189,458, 3,501,313; stannous salts, amines and other reducing substances, as described in U.S. Pats. Nos. 2,487,850, 2,518,698, 2,521,925, 2,521,926, 2,694,637, 2,983,610 and 3,201,254, etc.

If desired, the photographic emulsion can be supersensitized or spectrally sensitized using cyanine dyes such as cyanine, merocyanine and carbocyanine dyes, alone or as combinations thereof or in combination with styryl dyes. Such color sensitizing methods are well known, and are described, for example, in U.S. Pats. Nos. 2,493,748, 2,519,001, 2,977,229, 3,480,434, 3,672,897, 3,073,377, 2,688,545, 2,912,329, 3,397,060, 3,615,635 and 3,628,964, British Pats. Nos. 1,195,302, 1,242,588 and 1,293,862, German Pats. (OLS) Nos. 2,030,326, 2,121,780, Japanese Patent Publications Nos. 4,936/68, 14,030/69 and 10,773/68, U.S. Pat. Nos. 3,511,664, 3,522,052, 3,527,641, 3,615,613, 3,615,632, 3,617,295, 3,635,721, and 3,694,217, British Pats. Nos. 1,137,580 and 1,216,203, and the like. The selection depends on the wavelength to be sensitized, the purpose of the sensitive materials with regard to sensitivity and the end use of the sensitive materials.

The photographic sensitive materials of the present invention can contain as a plasticizer in the photographic layers polyols as described in U.S. Pats. Nos. 2,960,404, 3,042,524, 3,520,694, 3,656,956 and 3,640,721, if desired.

The photographic sensitive materials of the present invention generally have, in addition to a silver halide emulsion layer, conventional non-sensitive photographic layers such as a protective layer, filter layer, intermediate layer, antihalation layer, subbing layer, back layer, antistatic layer and curl balancing layer.

The photographic sensitive materials of the present invention can contain many other additional optional additives, e.g., a brightener, for example, stilbene, triazine, oxazole and coumarin compouds; ultraviolet absorbents, for example, benzotriazole, thiazolidine and a cinnamic acid ester compounds; light absorbents, various known photographic filter dyes; and if desired, besides the compounds of general formula (I) used in the present invention, other lubricant or adhesion preventing agents, for example, water insoluble substances as described in British Pat. Nos. 1,320,564 and 1,320,565 and U.S. Pat. No. 3,121,060 and surface active agents as described in U.S. Pat. No. 3,617,286. In addition, there can be added as matting agents inorganic compounds such as silver halide, silica and barium strontium sulfate and polymer latexes such as polymethylmethacrylate of a suitable particle size.

The photographic sensitive materials of the present invention can contain in the photographic layers, including a photographic emulsion layer, particularly in an antistatic layer provided as an outermost layer of the photographic material, an antistatic agent, for example, a hydrophilic polyol as described in U.S. Pats. No. 2,725,297, 2,972,535, 2,972,536, 2,972,537, 2,972,538, 3,033,679, 3,072,484, 3,262,807, 3,525,621, 3,615,531, 3,630,743, 3,653,906, 3,655,384 and 3,655,386 and British Pats. Nos. 1,222,154 and 1,235,075; hydrophobic polymers as described in U.S. Pats. Nos. 2,973,263 and 2,976,148; biguanide compound as described in U.S. Pats. Nos. 2,584,362, and 2,591,590; sulfonic acid anionic compounds as described in U.S. Pats. Nos. 2,639,234, 2,649,372, 3,201,251 and 3,457,076; phosphoric acid esters and quaternary ammonium salts as described in U.S. Pats. Nos. 3,317,344 and 3,514,291; cationic compounds as described in U.S. Pats. Nos. 2,882,157, 2,982,651, 3,399,995, 3,549,369 and 3,564,043; nonionic compounds as described in U.S. Pat. No. 3,625,695, amphoteric compounds as described in U.S. Pat. No. 3,736,268; complex compounds as described in U.S. Pat. No. 2,647,836; and organic salts as described in U.S. Pats. Nos. 2,717,834 and 3,655,387.

The present invention can be applied to various kinds of photographic sensitive materials, including both black-and-white and color materials.

The silver halide emulsions used in the present invention include various silver halide photographic emulsions, such as orthochromatic emulsions, panchromatic emulsions, emulsions for infrared rays, emulsions for X-rays and other invisible rays, color photographic emulsions such as emulsions containing color forming couplers, emulsions containing dye developers and emulsions containing dyes capable of being bleached and the like.

In using the silver halide emulsions of the present invention as color photographic materials, a sensitive photographic emulsion layer has added thereto a compound producing a dye on reaction with an oxidized developer, i.e., a coupler. Such coupler has a structure such that it is not diffused into other layers during manufacturing or processing.

As yellow couplers there are generally used open chain diketomethylene compounds. Examples of such couplers are given, for instance, in U.S. Pats. Nos. 3,341,331, 2,875,057, 3,551,155, 3,265,506, 3,582,322, 3,725,072, 3,369,895 and 3,408,194, and in German Patents (OLS) Nos. 1,547,868, 2,162,899, 2,057,941, 2,213,461, 2,219,917, 2,261,361 and 2,263,875.

As magenta couplers there are mainly used 5-pyrazolone compounds, but indazolone compounds and cyanoacetyl compounds are also sometimes used. Examples of such as described, for instance, in U.S. Pats. Nos. 2,439,098, 2,600,788, 3,062,653, 3,558,319, 3,582,323, 3,615,506, 3,519,429, 3,311,476, 3,419,391 and 2,983,608, British Pat. 956,261, Japanese Patent Applications Nos. 21,454/73, 56,050/73 and 45,971/73, German Pat. No. 1,810,464, and Japanese Patent Publication No. 2,016/69.

As cyan couplers, derivatives of phenol or naphthol are mainly used. Examples of such are described, for instance, in U.S. Pats. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034, 892, 3,583,971, German Pat. (OLS) No. 2,163,811, Japanese Patent Publication No. 28,836/70, Japanese Patent Application No. 33,238/73 and the like.

Further, during the coloring reaction a development inhibitor releasing type coupler (i.e., DIR coupler) or a compound releasing a development inhibitor compound can be present. Examples of such are described in U.S. Pats. Nos. 3,148,062, 3,227,554, 3,253,924, 3,617,291, 3,622,328, 3,705,201, British Pat. No. 1,201,110 and U.S. Pats. Nos. 3,297,445, 3,379,529, 3,639,417.

In order to satisfy the characteristics required for sensitive materials, it is possible to add two or more couplers as given above the same layer or to add the same coupler to two or more different layers.

In order to obtain color images from color photographic sensitive materials, development after exposure is necessary, of course.

Development basically includes a color development, a bleaching and a fixing. Each step can be practiced independently and two or more steps can be combined into one treatment using a treating liquid having such two or more functions, an example of which is a single bleach-fixing bath. Further, if desired, each step can be divided into two or moe parts, or it is also possible to conduct the treatment with combining color development, primary fixation and bleach-fixing. If desired, the development step can be combined with several steps such as prehardening, neutralizing, primary development (black and white development), image stabilizing and washing. The treating temperature is adjusted to a suitable range depending on the kind of sensitive material and the processing chosen. Although temperatures lower than 18° C can be used, temperatures of 18° C or more are frequently used. A particularly often used temperature range is 20° to 60° C, particularly 30° to 60° C. It is not necessary that the temperature in each step be the same.

The color developing solution is an aqueous alkali solution with a pH of about 8 or more, preferably 9 to 12, containing a compound whose oxidized product produces a dye on reaction with a coupler, i.e., a developing agent.

The developing agent is a compound having a primary amino group on an aromatic ring which is capable of developing the exposed silver halide, or a precursor thereof which forms such a compound. Representative examples include 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 4-amino-3-methyl-N-ethyl-N-β-methanesulfonamidoethylaniline, 4-amino-N,N-dimethylaniline, 4-amino-3-methoxy-N,N-diethylaniline, 4-amino-3-methyl-N-ethyl-N-β-methoxyethylaniline, 4-amino-3-methoxy-N-ethyl-N-β-methoxyethylaniline, 4-amino-3-β-methanesulfonamidoethyl-N,N-diethylaniline and salts thereof (e.g., sulfonate, hydrochloride, sulphite, p-toluenesulfonate, etc.). In addition, compounds as are described in U.S. Pats. Nos. 2,193,015 and 2,592,364, Japanese Patent Application (OPI) No. 64,933/73, and L.F.A. Mason, *Photographic Processing Chemistry,* Focal Press, London, pp. 226 – 229, 1966 can be used. Further, the above compounds can be used in combination with 3-pyrazolidones.

The color developing solution can, if desired, contain various additives, e.g., alkali agents (e.g., hydroxides, carbonates or phosphates of alkali metals or ammonium), pH adjusting agents or buffers (e.g., weak acids such as acetic acid or boric acid, weak bases or weak salts thereof), development accelerating agents (e.g., various pyridinium compounds and cationic compounds, potassium nitrate or sodium nitrate as described in U.S. Pats. Nos. 2,648,604 and 3,671,247, polyethylene glycol condensates or derivatives thereof as described in U.S. Pats. Nos. 2,533,990, 2,577,127 and 2,950,970, nonionic compounds such as polythioethers as described in British Pats. Nos. 1,020,033 and 1,020,032, polymeric compounds having a sulphite ester group as described in U.S. Pat. No. 3,068,097, organic amines such as pyridine and ethanolamine, benzyl alcohol and hydrazine), antifoggants (e.g., alkali metal bromides; alkali metal iodides; nitrobenzoimidazoles as described in U.S. Pats. Nos. 2,496,940 and 2,656,271; mercaptobenzoimidazole; 5-methylbenzotriazole; 1-phenyl-5-mercaptotetrazole; compounds for rapid treatments as described in U.S. Pat. Nos. 3,113,864, 3,342,596, 3,295,976, 3,615,522 and 3,597,199; thiosulfonyl compounds as described in British Patent 972,211; phenazine-N-oxides as described in Japanese Patent Publication 41,675/71; antifoggants as described in *Kagaku Shashin Binran,* (Vol. II, pp. 29 – 47), anti-stain agents or sludge preventing agents as described in U.S. Pats. Nos. 3,161,513 and 3,161,514 and in British Pats. Nos. 1,030,442, 1,144,481 and 1,251,558, inter-image effect accelerators and preservatives as described in U.S. Pat. No. 3,536,487 (e.g., a sulphite, acid sulfite, hydroxylamine hydrochloride, formaldehyde-bisulfite adduct, alkanolamine-sulfite adduct, etc.

The color sensitive materials are bleached after color development in a conventional manner. This treatment can be conducted simultaneously with or apart from fixing. The treating liquid used can, if desired, have added thereto a fixing agent to prepare a bleach-fixing bath. As bleaching agents, there are used alone or in mixture various compounds, particularly ferricyanates, bichromates, water soluble cobalt (III) salts, water soluble copper (II) salts, water soluble quinones, nitrosophenols, multivalent metal compounds such as iron (III), cobalt (III) and copper (II) compounds, particularly the complex salts of such a multivalent metal cation with an organic acid, such as a metal complex salt of an aminopolycarboxylic acid such as ethylenediaminetetraacetic acid, nitrilotriacetic acid, iminodiacetic acid, N-hydroxyethylethylenediaminetriacetic acid and the like; metal complex salts of malonic acid, tartaric acid, malic acid, diglycolic acid, and dithioglycolic acid; and copper complex salts of 2,6-dipicolinic acid, peracids such as alkyl peracid, persulfates, permanganates, hydrogen peroxide, hypochlorites, chlorine, bromine and bleaching powder.

Various additives including bleach accelerating agents as are described in U.S. Pats. Nos. 3,042,520 and 3,241,966 and Japanese Patent Publication Nos. 8,506/70 and 8,836/70 can be added to this treating liquid.

The compounds of general formula (I) improve physical properties such as resistance to the formation of surface defects and slippage without harming the photographic properties (e.g., causing fog, reducing sensitivity) of the photographic sensitive materials. The above compounds show a more excellent effect, particularly inhibiting abnormal coloration and other defects described above, with respect to the color photographic sensitive materials. This effect brings about the great advantage that the range of storage conditions and use conditions for unexposed and/or undeveloped photographic films can be widened.

The compounds of general formula (I) improve the handling of the photographic sensitive material, especially in cameras for movie films, printers and projectors, because they impart a desired slippage to the photographic sensitive materials.

Particularly in the case of color cinema films, abnormal coloration is liable to take place because a long time is required for processing and the films are tightly rolled; however, this coloration is completely inhibited by the present invention.

A further advantage of the present invention resides in the production of the photographic sensitive materials. That is, as described above, one preferred method of applying the compounds of the present invention to sensitive materials comprises adding to the hydrophilic colloid in the surface layer of a photographic sensitive material the compounds in the form of an aqueous dispersion prepared using a dispersing agent; in this case, the particle size and the stability with the passage of time of an emulsified dispersion containing the compound of general formula (I) is an important factor to facilitate the production of the sensitive materials. The compounds of general formula (I) facilitate the production of the sensitive materials, because the compounds are superior to conventional silicones in their emulsion dispersion tendency and in stability with the passage of time.

A further advantage is that the compounds of formula (I) do not adversely affect the coating characteristics of the hydrophilic colloid solution containing the compounds. In using conventional silicones, various problems with regard to coating characteristics occur when applying the hydrophilic colloid solution containing the silicone to a support. However, the hydrophilic coating solution containing the compounds of general formula (I) has good coating characteristics.

Having thus generally described the present invention, the following Examples of currently preferred modes of practicing the invention are offered to more specifically illustrate the present invention without limiting the same.

In the following Examples all parts and percentages are by weight, unless otherwise indicated.

EXAMPLE 1

A coating liquid (back liquid) having the composition shown in Table 1 was coated on a triacetyl cellulose photographic film support in an amount of 40 cc/m² and dried for 3 minutes at 90° C to form an antihalation layer.

TABLE 1

| | Back Liquid | | |
|---|---|---|---|
| | 1-1 (parts) | 1-2 (parts) | 1-3 (parts) |
| Hydroxypropylmethylcellulose hexahydrophthalate comprising*: Hexahydrophthalyl groups 38 wt%; Hydroxypropoxy groups 8 wt%: and Methoxy groups 16 wt%. | 20 | " | " |
| Carbon black | 9.6 | " | " |
| Acetone | 600 | " | " |
| Methyl cellosolve | 150 | " | " |
| Methanol | 200 | " | " |
| Diacetone alcohol | 50 | " | " |
| Compound (I) | — | 5 | — |
| Comparison Compound A | — | — | 5 |
| Sample No. of the base coated with the obtained antihalation layer | Base 1-1 | Base 1-2 | Base 1-3 |

*The balance is the mother nucleus of the cellulose.

Structure of comparison compound A:

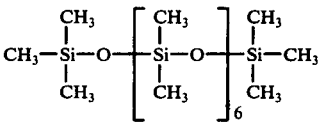

A red sensitive emulsion layer, a gelatin intermediate layer, a green sensitive layer, a yellow filter layer, a blue sensitive layer and protective layer were coated in this order on the above base provided on the opposite side thereof with three kinds of antihalation layers to obtain corresponding highly sensitive cinema color negative films 1-1, 1-2 and 1-3. A silver iodobromide emulsion containing 6 mol% of iodine was used for the red sensitive and green sensitive emulsions. A silver iodobromide emulsion containing 8 mol% of iodine was used for the blue sensitive emulsion. These films were stored for 1 week at 125° C under 60% RH and thereafter subjected to abnormal coloration tests. In this test the sample was cut into 4 cm square pieces, conditioned for 2 days in a vessel at constant temperature and humidity as described in Table 2, and thereafter an emulsion layer of one sample and back layer of another sample were superposed and placed under a load for 2 days at 50 g/cm². Then, the adhered films were stripped and subjected to the following development treatment without exposure. The abnormal coloration effect was expressed by the area (%) of the abnormal yellow coloration as shown in Table 2.

| Treatment Steps | Temperature (° C) | Time (minutes/seconds) |
|---|---|---|
| Pre-bath | 26.5 | 10″ |
| Rinse | 38 | 5″ |
| Development | 41.1 | 3′ 00″ |
| Stopping | 38 | 30″ |
| Washing with water | 38 | 30″ |
| Bleach | 38 | 3′ 00″ |
| Washing with water | 38 | 2′ 00″ |
| Fixing | 38 | 2′ 00″ |
| Washing with water | 38 | 2′ 00″ |
| Stabilizing bath | 38 | 10″ |
| Pre Bath | | |
| Water | | 800 cc |
| Borax (decahydrate) | | 20 g |
| Anhydrous Glauber's salt | | 100 g |
| NaOH | | 1 g |
| Water to make | | 1 l |
| | | (pH 9.26) |
| Stopping Bath | | |
| Water | | 900 cc |
| 7.0 N sulfuric acid | | 50 cc |
| Water to make | | 1 l |
| | | (pH 0.9) |
| Fixing Bath | | |
| Water | | 700 cc |
| 58% Ammonium thiosulfate | | 185 cc |
| Sodium sulfite | | 10 g |
| Sodium bisulfite | | 8.4 g |
| Water to make | | 1 l |
| | | (pH 6.5) |
| Stabilizing Bath | | |
| Water | | 1 l |
| Kodak PHOTOFLO 600 (Silicone surface active agent) | | 2 cc |
| Developing Bath | | |
| Water | | 850 cc |
| Kodak Anticalcium No. 4 | | 2 cc |
| Anhydrous sodium sulfite | | 2 g |
| 3,5-Dinitrobenzoic acid | | 0.22 g |
| NaBr | | 1.2 g |
| Sodium carbonate | | 25.6 g |
| Sodium bicarbonate | | 2.7 g |
| Kodak CD-3* | | 4.0 g |
| Water to make | | 1 l |
| | | (pH 10.20) |
| Bleach | | |
| Water | | 800 cc |
| KBr | | 126 g |
| $NaBrO_3$ | | 13.7 g |
| $H_3BO_3$ | | 2.4 g |
| EDTA**-Fe(III)-$NH_4$ | | 45.4 g |
| EDTA | | 8.2 g |
| 28% $NH_4OH$ (added to adjust pH to 6.7) | | |
| Water to make | | 1 l |

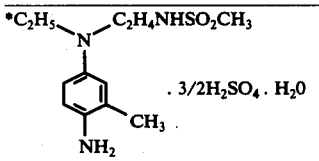

**Ethylenediaminetetraacetic acid

TABLE 2

| Films | Area of Abnormal Coloration 30° C, 90% RH* | 40° C, 90% RH* |
|---|---|---|
| 1-1 | 5% | 30% |
| 1-2 | 0% | 5% |
| 1-3 | 5% | 25% |

*Constant storage conditions under load

As can be understood from the values of Table 2, compound (1) of the present invention remarkably prevents abnormal coloration as compared to the use of non-addition and addition of comparison compound A.

EXAMPLE 2

A coating liquid (back liquid) having the following composition was coated on a triacetyl cellulose photographic film support in an amount of 40 cc/m² and dried at 90° C for 3 minutes to form an antilhalation layer.

TABLE 3

| | Back Liquid 2-1 (parts) | 2-2 (parts) | 2-3 (parts) |
|---|---|---|---|
| Hydroxypropylmethylcellulose-hexahydrophthalate (the same with Example 1) | 10 | " | " |
| Spirit Black (C.I. 50415) | 5.3 | " | " |
| Ethanol | 600 | " | " |
| Sodium laurylsulfonate | 0.5 | " | " |
| Compound (1) | — | 5 | — |
| Compound A | — | — | 5 |
| Sample No. of the base coated with the obtained antihalation layer | Base 2-1 | Base 2-2 | Base 2-3 |

The lighly sensitive cinema color negative emulsion system used in Example 1 was coated on bases 2-1, 2-2 and 2-3 to obtain films 2-1, 2-2 and 2-3. An abnormal coloration test as in Example 1 was conducted and the following results were obtained

TABLE 4

| Films | Conditions: Area of Abnormal Coloration 30° C, 90% RH* | 40° C, 90% RH* |
|---|---|---|
| 2-1 | 25% | 50% |
| 2-2 | 3% | 5% |
| 2-3 | 15% | 50% |

*Same as in Example 1.

It can be seen from the values of Table 4 that the area of abnormal coloration is remarkably lessened with film 2-2 of the present invention.

EXAMPLE 3

Back liquid 1-1 used in Example 1 was coated on a cellulose triacetate base in an amount of 40 cc/m² and dried for 3 minutes at 90° C to obtain an antihalation layer. This anithalation layer was further coated with the following coating liquid, followed by drying for 3 minutes at 90° C.

TABLE 5

| | Coating Liquid 3-1 (parts) | 3-2 (parts) | 3-3 (parts) |
|---|---|---|---|
| Butanol | 1,000 | | |
| Methyl glycol | 100 | | |
| Compound (1) | | 3 | |
| Compound A | | | 3 |
| Sample No. of the obtained base | Base 3-1 | Base 3-2 | Base 3-3 |

The highly sensitive screen color negative emulsion system used in Example 1 was coated on above bases 3-2, 3-2 and 3-3 to obtain films 3-1, 3-2 and 3-3. An abnormal coloration test as Example 1 was conducted, and the following results were obtained.

TABLE 6

| Films | Conditions: Area of Abnormal Coloration 30° C, 90% RH* | 40° C, 90% RH* |
|---|---|---|
| 3-1 | 3% | 20% |
| 3-2 | 0% | 2% |
| 3-3 | 3% | 20% |

*Same as Example 1.

It can be seen from the values in Table 6 that the area of abnormal coloration was remarkably lessened with film 3 -2 of the present invention.

EXAMPLE 4

Back liquid 1-1 used in Example 1 was coated on a cellulose triacetate base in an amount of 15 cc/m² and dried for 3 minutes at 90° C to obtain an antihalation layer. This antihalation layer was further coated with a coating liquid having the following composition, followed by drying for 3 minutes at 90° C.

TABLE 7

| | Coating Liquid | | |
|---|---|---|---|
| | 4-1 (parts) | 4-2 (parts) | 4-3 (parts) |
| Butanol | 1,000 | " | |
| Methyl glycol | 100 | " | |
| Hydroxypropylmethylcellulose-hexahydrophthalate (the same as in Example 1) | 5 | " | |
| Polyacrylonitrile particles (size: 1 - 5 μ) | 0.5 | " | |
| Compound (1) | — | 3 | — |
| Compound A | — | — | 3 |
| Sample No. of the obtained base | Base 4-1 | Base 4-2 | Base 4-3 |

A highly sensitive screen color negative emulsion system was used in Example 1 was coated on the above bases 4-1, 4-2 and 4-3 to obtain films 4-1, 4-2 and 4-3.

An abnormal coloration test as in Example 1 was conducted, and the following results were obtained.

TABLE 8

| | Conditions | |
|---|---|---|
| | Area of Abnormal Coloration | |
| Films | 30° C, 90% RH* | 40° C, 90% RH* |
| 4-1 | 2% | 10% |
| 4-2 | 0% | 0% |
| 4-3 | 2% | 16% |

*Same as in Example 1.

It can be seen from the values in Table 8 that the area of abnormal coloration was remarkedly lessened with film 4-2 of the present invention.

EXAMPLE 5

A coating liquid (back liquid) having the following composition was coated on a triacetylcellulose photographic film support in an amouont of 50 cc/mand dried for 2 minutes at 70° C to form a back surface layer.

TABLE 9

| | Back Liquid | | |
|---|---|---|---|
| | 5-1 (parts) | 5-2 (parts) | 5-3 (parts) |
| Cellulose | 5 | " | " |
| Acetone | 700 | " | " |
| Methanol | 300 | " | " |
| Compound (1) | — | 4 | — |
| Compound A | — | — | 4 |
| Sample No. of the obtained base | Base 5-1 | Base 5-2 | Base 5-3 |

A highly sensitive color negative emulsion as was used in Example 1 was coated on the above bases 5-1, 5-2 and 5-3 to obtain films 5-1, 5-2 and 5-3, and an abnormal coloration test as in Example 1 was conducted. The results are shown in Table 10.

TABLE 10

| | Conditions | |
|---|---|---|
| | Area of Abnormal Coloration | |
| Films | 30° C, 90% RH* | 40° C, 90% RH* |
| 5-1 | 35% | 65% |
| 5-2 | 5% | 10% |
| 5-3 | 25% | 65% |

*Same as in Example 1.

It can be seen from the values in Table 10 that the area of abnormal coloration was remarkably lessened with film 5-2 of the present invention.

EXAMPLE 6

A coating liquid having the following composition was coated on the back surface layer of base 5-1 shown in Example 5 in an amount of 10 cc/m² and dried for 2 minutes at 70° C.

TABLE 11

| | Coating Liquid | | | | |
|---|---|---|---|---|---|
| | 6-1 (parts) | 6-2 (parts) | 6-3 (parts) | 6-4 (parts) | 6-5 (parts) |
| Acetone | 200 | " | " | " | " |
| Methancl | 800 | " | " | " | " |
| Fine particled silica (size: below 1 μ) | 0.5 | " | " | " | " |
| Antistatic agent B | — | — | — | 4 | — |
| Antistatic agent C | — | — | — | — | 4 |
| Compound (1) | — | 4 | — | 4 | 4 |
| Compound A | — | — | 4 | — | — |
| Sample No. of obtained base | Base 6-1 | Base 6-2 | Base 6-3 | Base 6-4 | Base 6-5 |

A highly sensitive color negative emulsion system as was used in Example 1 was coated on the above bases 6-1, 6-2, 6-3, 6-4 and 6-5 to obtain films 6 -1, 6-2, 6-3, 6-4 and 6-5.

STRUCTURE OF THE COMPOUND B

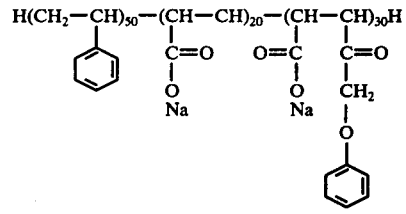

STRUCTURE OF THE COMPOUND C

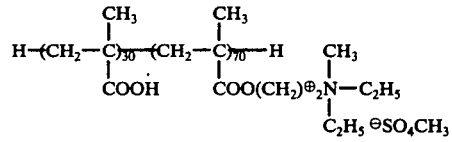

An abnormal coloration test as in Example 1 was conducted, and the following results were obtained.

TABLE 12

| | Conditions | |
|---|---|---|
| | Area of Abnormal Coloration | |
| Films | 30° C, 90% RH* | 40° C, 90% RH* |
| 6-1 | 30% | 55% |
| 6-2 | 4% | 7% |
| 6-3 | 20% | 50% |
| 6-4 | 2% | 4% |
| 6-5 | 2% | 3% |

*Same as in EXample 1.

It can be from the values in Table 12 that the area of abnormal coloration is remarkably lessened with films 6-2, 6-4 and 6-5 of the present invention.

EXAMPLE 7

A red sensitive emulsion layer, gelatin intermediate layer, green sensitive layer, yellow filter layer and blue sensitive emulsion layer the same as in Example 1 were laid in this order on bases 1-1, 1-2 and 1-3 obtained in Example 1. Further, the following 4 kinds of surface protective layers were coated thereon as an outermost layer to obtain 4 samples.

TABLE 13

| | Surface Protective Layer Liquid | | | |
|---|---|---|---|---|
| | 7-1 | 7-2 | 7-3 | 7-4 |
| | (parts) | (parts) | (parts) | (parts) |
| 5% bone gelatin aqueous solution | 1,000 | " | " | " |
| 5% sodium dodecyl-benzene sulfonate | 20 | " | " | " |
| 2% vinylsulfonyl-alkyl type hardener (bis-vinylsulfonyl-methylether) | 20 | " | " | " |
| Polymethylmethacrylate (average particle size 2 μ) spherical particles | 1 | " | " | " |
| Emulsion dispersion of compound (1)* | — | 30 | — | — |
| Emulsion dispersion of compound (2)* | — | — | 30 | — |
| 9% methanol solution of compound (4) | — | — | — | 30 |
| Sample No. of the coated film | Film obtained | | | |
| Base 1-1 | 7-11 | 7-12 | 7-13 | 7-14 |
| Base 1-2 | 7-21 | 7-22 | 7-23 | 7-24 |
| Base 1-3 | 7-31 | 7-32 | 7-33 | 7-34 |

An abnormal coloration test was conducted as in Example 1 but, the pressure adhesion time was extended to 4 days in order to evaluate the Samples under more severe conditions.

TABLE 14

| | Conditions(%) | |
|---|---|---|
| | Area of Abnormal Coloration | |
| Films | 30° C, 90% RH | 40° C, 90% RH |
| 7-11 | 20 | 75 |
| 7-12 | 15 | 30 |
| 7-13 | 15 | 45 |
| 7-14 | 10 | 40 |
| 7-21 | 5 | 15 |
| 7-22 | 3 | 10 |
| 7-23 | 3 | 10 |
| 7-24 | 3 | 8 |
| 7-31 | 15 | 50 |
| 7-32 | 10 | 30 |
| 7-33 | 12 | 35 |
| 7-34 | 8 | 30 |

As is seen from Table 14, it is apparent that the treatment of a base in accordance with the present invention provides a great contribution to prevent abnormal coloration and that the effect appears when the compound of the present invention is contained in a surface protective layer.

| | |
|---|---|
| 10% bone gelatin | 100 g |
| 5% sodium dodecylbenzenesulfonate | 3 g |
| Compound (1) or (2) | 10 g |

While the invention has been described in detail and with reference to specific embodiments thereof, it will be apparent to one skilled in the art that various changes and modifications can be made therein without departing from the spirit and scope thereof.

What is claimed is:

1. A photographic sensitive material comprising a support having thereon at least one silver halide photographic emulsion layer, wherein at least one surface layer of the photographic sensitive material contains an alkylpolysiloxane having in the side chain thereof a polyoxyethylene chain, said alkylpolysiloxane being represented by the following general formula (I):

(I)

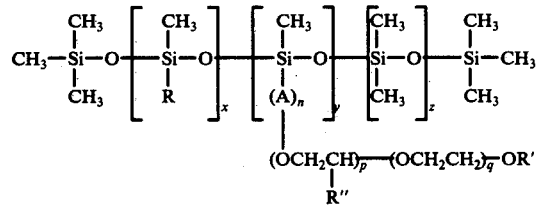

in which R represents an aliphatic group or aryl group, R′ represents a hydrogen atom, an aliphatic or an aryl group, R″ represents an alkyl group or alkoxyalkyl group, A represents a divalent residue of an aliphatic hydrocarbon, $n$ represents 0 or an integer of 1 to 12, $p$ represents a value of 0 to 50, $q$ represents a value of 2 to 50, $x$ represents a value of 0 to 100, $y$ represents a value of 1 to 50, $z$ represents a value of 0 to 100 and $x + y + z$ represents a value of 5 to 250.

2. The photographic sensitive material as claimed in claim 1, wherein said compound of general formula (I) is contained in a back layer of the photographic sensitive material.

3. A method of preventing fog which comprises incorporating in at least one surface layer of a photographic sensitive material, said photographic sensitive having thereon at least one silver halide photographic emulsion layer, a compound represented by general formula (I):

(I)

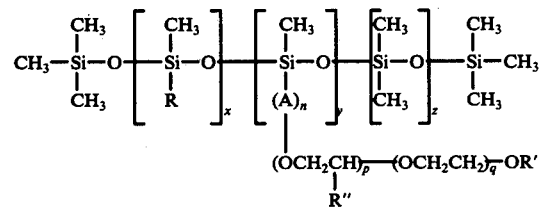

in which R represents an aliphatic group or aryl group, R′ represents a hydrogen atom, an aliphatic group or an aryl group, R″ represents an alkyl group or alkoxyalkyl group, A represents a divalent residue of an aliphatic hydrocarbon, $n$ represents 0 or integer of 1 to 12, $p$ represents a value of 0 to 50, represents a value of 2 to 50, $x$ represents a value of 0 to 100, $y$ represents a value of 1 to 50, $z$ represents a value of 0 to 100 and $x + y + z$ represents a value of 5 to 250.

4. The method of preventing fog as claimed in claim 3, wherein said compound of general formula (I) is contained in a back layer of the photographic sensitive material.

5. A method of preventing abnormal coloration which comprises incorporating in at least one surface layer of a photographic sensitive material, said photographic sensitive material having thereon at least one silver halide photographic emulsion layer, a compound represented by general formula (I):

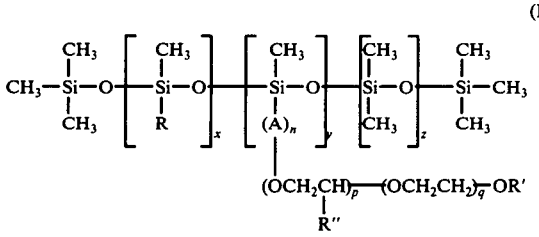

(I)

in which R represents an aliphatic group or aryl group, R′ represents a hydrogen atom, an aliphatic group or an aryl group, R″ represents an alkyl group or alkoxyalkyl group, A represents a divalent residue of an aliphatic hydrocarbon, $n$ represents 0 or integer of 1 to 12, $p$ represents a value of 0 to 50, $q$ represents a value of 2 to 50, $x$ represents a value of 0 to 100, $y$ represents value of 1 to 50, $z$ represents a value of 0 to 100 and $x + y + z$ represents a value of 5 to 250.

6. The method of preventing abnormal coloration as claimed in claim 5, wherein said compound of general formula (I) is contained in a back layer.

7. The photographic sensitive material as claimed in claim 1, wherein said surface layer containing said compound of the formula (I) is a non-sensitive photographic layer.

8. The method of preventing fog as claimed in claim 3, wherein said surface layer into which has been incorporated the compound of formula (I) is a non-sensitive photographic layer.

9. The method of preventing abnormal coloration as claimed in claim 5, wherein said surface into which has been incorporated the compound of Formula (I) is a non-sensitive photographic layer.

10. The photographic sensitive material as claimed in claim 1, wherein said aliphatic group for R is i. an alkyl having 1 to 18 carbon atoms;
ii. an aralkyl group having 7 to 18 carbon atoms;
iii. an alkoxyalkyl group having 2 to 18 carbon atoms; or
iv. an aryloxyalkyl group having 7 to 18 carbon atoms, wherein said aryl group for R is v. a monoaryl group, wherein said alipatic group for R′ is vi. an alkyl group having 1 to 12 carbon atoms; or
vii. an aralkyl group having 7 to 12 carbon atoms, wherein said aryl group for R′ is viii. a monoaryl group, wherein said alkyl group for R″is ix. an alkyl group having 1 to 3 carbon atoms; and wherein said alkoxyalkyl group for R″ is x. an alkoxyalkyl group having 2 to 8 carbon atoms.

11. The method of preventing fog as claimed in claim 3, wherein said aliphatic group for R is i. an alkyl group having 1 to 18 carbon atoms;
ii. an aralkyl group having 7 to 18 carbon atoms;
iii. an alkoxyalkyl group having 2 to 18 carbon atoms; or
iv. an aryloxyalkyl group having 7 to 18 carbon atoms, wherein said aryl group for R is v. a monoaryl group, wherein said aliphatic group for R′ is vi. an alkyl group having 1 to 12 carbon atoms; or
vii. an aralkyl group having 7 to 12 carbon atoms, wherein said aryl group for R′ is viii. a monoaryl group, wherein said alkyl group R″ is ix. an alkyl group having 1 to 3 carbon atoms; and wherein said alkoxyalkyl group for R″ is
x. an alkoxyalkyl group having 2 to 8 carbon atoms.

12. The method of preventing abnormal coloration as claimed in claim 5, wherein said aliphatic group for R is i. an alkyl group having 1 to 18 carbon atoms;
ii. an aralkyl group having 7 to 18 carbon atoms;
iii. an alkoxyalkyl group having 2 to 18 carbon atoms; or
iv. an aryloxyalkyl group having 7 to 18 carbon atoms, wherein said aryl group for R is v. a monoaryl group, wherein said aliphatic group for R′ is vi. an alkyl group having 1 to 12 carbon atoms; or
vii. an aralkyl group having 7 to 12 carbon atoms, wherein said aryl group for R′ is viii. a monoaryl group, wherein said alkyl group for R″ is ix. an alkyl group having 1 to 3 carbon atoms; and wherein said alkoxyalkyl group for R″ is x. an alkoxyalkyl group having 2 to 8 carbon atoms.

13. The photographic sensitive material as claimed in claim 1, wherein $q$ represents a value of 2 to 30 and $x + g + z$ represents a value of 10 to 50.

14. The method of preventing fog as claimed in claim 3, wherein $q$ represents a value of 2 to 30 and $x + y + z$ represents a value of 10 to 50.

15. The method of preventing abnormal coloration as claimed in claim 5, wherein $q$ represents a value of 2 to 30 and $x + y + z$ represents a value of 10 to 50.

16. The photographic sensitive material as claimed in claim 1, wherein said compound of Formula (I) is present in said surface layer in an amount of about 0.01 to about 5.0 grams per square meter.

17. The method of preventing fog as claimed in claim 3, wherein said compound of Formula (I) is incorporated in said surface layer in an amount of about 0.01 to about 5.0 grams per square meter.

18. The method of preventing abnormal coloration as claimed in claim 5, wherein said compound of Formula (I) is incorporated in said surface layer in an amount of about 0.01 to about 5.0 grams per square meter.

19. The photographic sensitive material as claimed in claim 2, wherein said back layer comprises a binder and said compound of Formula (I) in an amount of about 1 to about 300 weight percent of said binder.

20. The method of preventing fog as claimed in claim 4, wherein said back layer comprises a binder and said compound of Formula (I) in an amount of about 1 to about 300 weight percent of said binder.

21. The method of preventing abnormal coloration as claimed in claim 6, wherein said back layer comprises a binder and said compound of Formula (I) in an amount of about 1 to about 300 weight percent of said binder.

* * * * *